US009548173B2

(12) United States Patent
Connell

(10) Patent No.: US 9,548,173 B2
(45) Date of Patent: Jan. 17, 2017

(54) ELECTRICAL CONTACTOR

(71) Applicant: Johnson Electric S.A., Murten (CH)

(72) Inventor: Richard Anthony Connell, Cambridge (GB)

(73) Assignee: JOHNSON ELECTRIC S.A., Murten (CH)

( * ) Notice: Subject to any disclaimer, the term of this patent is extended or adjusted under 35 U.S.C. 154(b) by 0 days.

(21) Appl. No.: 14/622,378

(22) Filed: Feb. 13, 2015

(65) Prior Publication Data

US 2015/0228428 A1 Aug. 13, 2015

(30) Foreign Application Priority Data

Feb. 13, 2014 (GB) ..... 1402560.5

(51) Int. Cl.
*H01H 9/00* (2006.01)
*H01H 50/16* (2006.01)

(52) U.S. Cl.
CPC ..... *H01H 50/16* (2013.01)

(58) Field of Classification Search
CPC ..... H01H 51/12; H01H 50/24; H01H 50/14; H01H 50/44; H01H 50/60; H01H 50/443
USPC ..... 335/179
See application file for complete search history.

(56) References Cited

U.S. PATENT DOCUMENTS 2,149,699 A * 3/1939 Charles ..... H01H 51/04 335/136
2,446,299 A * 8/1948 Nelsen ..... H01H 51/10 318/261
2,458,939 A * 1/1949 Hall ..... H02H 7/093 318/367
2,467,720 A * 4/1949 Bascum ..... H01H 83/08 200/508
2,542,945 A * 2/1951 Rojas ..... H01H 51/10 307/127
2,564,246 A * 8/1951 Bourne ..... H01H 51/12 200/6 C
2,755,354 A * 7/1956 Dehn ..... H01H 50/323 200/50.32

(Continued)

FOREIGN PATENT DOCUMENTS

GB 1564637 4/1980
GB 2299896 10/1996
GB 2511569 9/2014

*Primary Examiner* — Shawki S Ismail
*Assistant Examiner* — Lisa Homza
(74) *Attorney, Agent, or Firm* — Muncy, Geissler, Olds & Lowe, P.C.

(57) ABSTRACT

An electrical contactor has first and second terminals; a movable arm connected to the second terminal; and an actuator. The actuator has a magnet, first and second coils having a common connection and located either side of the magnet, a magnetic rocking armature pivotably attached between the coils and an actuation element connected to the first end of the rocking armature for actuating the movable arm. Driving the first coil causes a demagnetization of the first coil and a corresponding increase in magnetic flux in the second coil, latching the armature to the second coil and moving the movable arm in a first direction. Driving the second coil causes a demagnetization of the second coil and a corresponding increase in magnetic flux in the first coil, latching the rocking armature to the first coil and moving the movable arm in a second direction.

20 Claims, 7 Drawing Sheets

(56) References Cited

U.S. PATENT DOCUMENTS 2,844,684 A * 7/1958 Anderson et al. ..... H01H 50/32 200/243
2,846,542 A * 8/1958 Stanley ..... H01H 51/2272 335/80
2,941,130 A * 6/1960 Krautwald ..... H01H 50/16 335/230
2,955,174 A * 10/1960 Richert ..... H01H 51/01 174/88 B
3,001,049 A * 9/1961 Didier ..... H01H 51/12 335/124
3,321,722 A * 5/1967 Cohen ..... H01H 50/34 335/128
3,497,841 A * 2/1970 Marvin ..... H01H 51/01 335/179
3,534,307 A * 10/1970 Bratkowski ..... H01H 51/01 335/170
4,259,652 A * 3/1981 Mattson ..... H01H 51/2281 335/128
4,286,244 A * 8/1981 Schuessler ..... H01H 51/2281 335/230
4,499,442 A * 2/1985 Kamo ..... H01H 50/548 335/79
4,695,813 A * 9/1987 Nobutoki ..... H01H 51/229 335/124
4,703,293 A * 10/1987 Ono ..... H01H 51/229 335/230
4,747,010 A * 5/1988 Bayer ..... H01H 51/2281 335/177
5,117,209 A * 5/1992 Sato ..... H01H 50/026 335/78
5,359,305 A * 10/1994 Kitamura ..... H01H 50/16 335/129
5,382,934 A * 1/1995 Hendel ..... H01H 51/005 335/159
5,515,019 A * 5/1996 Schedele ..... H01H 50/026 335/130
5,612,658 A * 3/1997 Hendel ..... H01H 51/005 335/128
5,801,608 A * 9/1998 Mader ..... H01H 50/54 335/128
5,844,456 A * 12/1998 Mader ..... H01H 50/026 335/128
5,994,987 A * 11/1999 Passow ..... H01H 71/323 335/124
6,768,405 B2 * 7/2004 Nishida ..... H01H 50/026 335/136
6,856,219 B2 * 2/2005 Kawai ..... H01H 59/0009 200/181
7,286,030 B2 * 10/2007 Janot ..... H01H 49/00 335/4
7,477,119 B2 * 1/2009 Wu ..... H01H 50/043 335/128
7,633,363 B2 * 12/2009 Fausch ..... H01H 50/026 335/124
7,659,800 B2 * 2/2010 Gruner ..... H01H 1/26 335/185
8,237,523 B2 * 8/2012 Helmreich ..... H01H 50/548 200/400
8,330,564 B2 * 12/2012 Miller ..... H01H 1/54 335/128
8,680,957 B2 * 3/2014 Kato ..... H01H 50/043 335/202
8,773,226 B2 * 7/2014 Li ..... H01H 51/2272 335/128
2009/0231070 A1 * 9/2009 Saruwatari ..... H01H 50/04 335/179
2012/0206222 A1 * 8/2012 Gruner ..... H01H 1/54 335/177
2013/0176017 A1 * 7/2013 Connell ..... G01R 11/04 324/157
2013/0181793 A1 * 7/2013 Bauer ..... H01H 50/541 335/133
2015/0015349 A1 * 1/2015 Connell ..... H01H 3/001 335/15
2015/0318134 A1 * 11/2015 Connell ..... H01H 1/54 335/133

* cited by examiner

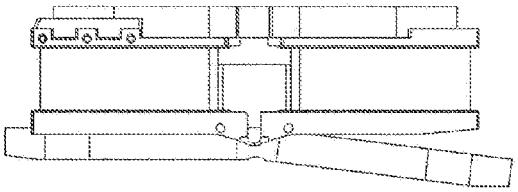

Left Hand Side armlet of rocking armature latched

FIG. 7a

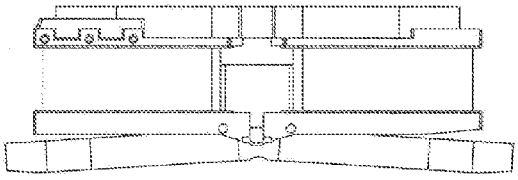

Left Hand Side coil energised

Left Hand Side coil de-magnetised

Right Hand Side coil experiences greater magnetic flux

FIG. 7b

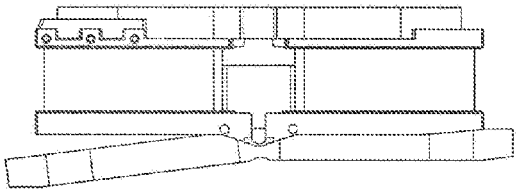

Right Hand Side armlet of rocking armature latched

FIG. 7c

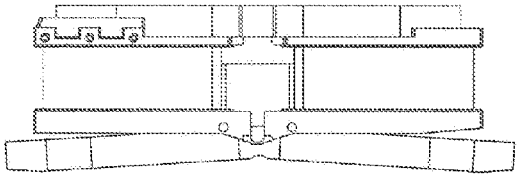

Right Hand Side coil energised

Right Hand Side coil de-magnetised

Left Hand Side coil experiences greater magnetic flux

FIG. 7d

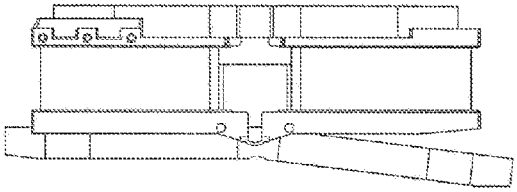

Left Hand Side armlet of rocking armature latched

FIG. 7e

ELECTRICAL CONTACTOR

CROSS REFERENCE TO RELATED APPLICATIONS

This non-provisional patent application claims priority under 35 U.S.C. §119(a) from Patent Application No. GB1402560.5 filed in The United Kingdom on Feb. 13, 2014, the entire contents of which are hereby incorporated by reference.

FIELD OF THE INVENTION

This invention relates to an electrical contactor.

BACKGROUND OF THE INVENTION

The present invention relates to an electrical contactor, particularly but not necessarily exclusively for moderate AC switching contactors employed in modern electricity meters, so-called 'smart meters', for performing a load-disconnect function at normal domestic supply mains voltages, typically being 100 V AC to 250 V AC. The invention may also relate to an electrical contactor of a moderate, preferably alternating, current switch which may be subjected to a short-circuit fault condition requiring the contacts to not weld. In this welded-contact fault condition, un-metered electricity is supplied. This can lead to a life-threatening electrical shock hazard, if the load connection that is thought to be disconnected is still live at 230 V AC. Furthermore, the present invention relates to a switch member for such an electrical contactor and/or to a method of controlling electrical contact closing and opening delay, thereby reducing contact erosion, arcing and/or tack welding.

Additionally, it is a requirement that the opening and closing timing of the electrical contacts in such a moderate-current switch should be more precisely controlled to reduce or prevent arcing damage thereby increasing their operational life.

It is known that many electrical contactors are capable of switching nominal current at, for example, 100 Amps, for a large number of switching load cycles. The switch contacts utilize a suitable silver-alloy which prevents tack-welding. The switch arm carrying the movable contact must be configured to be easily actuated for the disconnect function, with minimal self-heating at the nominal currents concerned.

Most meter specifications stipulate satisfactory nominal-current switching through the operational life of the device without the contacts welding. However, it is also required that, at moderate short-circuit fault conditions, the contacts must not weld and must open on the next actuator-driven pulse drive. At much higher related dead-short fault conditions, it is stipulated that the switch contacts may weld safely. In other words, the movable contact set must remain intact, and must not explode or emit any dangerous molten material during the dead-short duration, until protective fuses rupture or circuit breakers drop-out and disconnect the Live mains supply to the load. This short-circuit duration is usually for only one half-cycle of the mains supply, but in certain territories it is required that this short-circuit duration can be as long as four full cycles.

In Europe, and most other countries, the dominant meter-disconnect supply is single-phase 230 V AC at 100 Amps, and more recently 120 Amps, in compliance with the IEC 62055-31 specification. Technical safety aspects are also covered by other related specifications such as UL 508, ANSI C37.90.1, IEC 68-2-6, IEC 68-2-27, IEC 801.3.

There are many moderate-current meter-disconnect contactors known that purport to satisfy the IEC specification requirements, including withstanding short-circuit faults and nominal current through the operational life of the device. The limiting parameters may also relate to a particular country, wherein the AC supply may be single-phase with a nominal current in a range from 40 to 60 Amps at the low end, and up to 100 Amps or more recently to a maximum of 120 Amps. For these metering applications, the basic disconnect requirement is for a compact and robust electrical contactor which can be easily incorporated into a relevant meter housing.

In the context of the IEC 62055-31 specification, the situation is more complex. Meters are configured and designated for one of several Utilization Categories (UC) representing a level of robustness regarding the short-circuit fault-level withstand, as determined by certain tests carried out for acceptable qualification or approval. These fault-levels are independent of the nominal current rating of the meter.

Acting as an actuation means, there will typically be an armature or plunger which is driven to control the opening and closing of the contacts. However, a typical actuator can only provide an actuation in a single direction, which can cause problems in multi-pole contactors.

Some contactors utilize parallel or substantially parallel movable arms which are simultaneously actuated by a wedge-shaped member which is forced between them, separating the arms and breaking two contacts simultaneously. However, there can be an advantage to providing movable arms arranged in an anti-parallel configuration, to maximize repulsion forces between the arms to enhance the contact pressure when engaged. Such an arrangement however, cannot be achieved with an actuation in a single direction.

The present invention seeks to provide solutions to the afore-mentioned problems by providing a contactor having an actuator with a rocking armature.

SUMMARY OF THE INVENTION

According to a first aspect of the invention, there is provided an electrical contactor comprising: a first terminal having a fixed member with at least one fixed electrical contact; a second terminal; an electrically-conductive movable arm in electrical communication with the second terminal and having a movable electrical contact thereon; and actuator including a centrally mounted magnet, first and second drivable coils located either side of the magnet, a magnetically-attractable rocking armature pivotable at a point between the first and second coils, and an actuation element connected to an end of the rocking armature for actuating the movable arm; wherein driving the first coil causes a decrease of magnetic flux in the first coil, causing a corresponding increase in magnetic flux in the second coil, the rocking armature thus latching to the second coil, thereby actuating the movable arm in a first direction, and driving the second coil causes a decrease of magnetic flux in the second coil, causing a corresponding increase in magnetic flux in the first coil, the rocking armature thus latching to the first coil, thereby actuating the movable arm in a second direction.

The advantage of such an electrical contactor having a pivoting actuator is that a compact device can be created in which two actuations can be simultaneously made, should there be an actuation element attached at either end of the rocking armature. This allows for an opposingly cantilevered arrangement of movable arms wherein a simultaneous opening or closing of contacts can be achieved in a single latching motion.

Preferably, the first and second coils may be interconnected to a common center connection.

Interconnecting the first and second coils may beneficially allow the first coil to experience a net tempering or feedback effect when the second coil is driven, and vice versa. Careful optimization of the features of the coils allows for a dynamic delay to be added to the closing of the contacts, enabling the contact erosion energy to be minimized by tuning the closing time to a zero-crossing of an associated load current waveform.

Preferably, the movable arm may be a bladed switch. More preferably, the movable arm may be split into a blade set having a plurality of movable contacts, and most preferably, the movable arm may be a tri-bladed switch.

Beneficially, the movable arm may include at least two electrically-conductive overlying layers, thereby reducing a flexure force. The movable arms may thus be of a composite structure.

By separating the movable arm into separate individual blades, the effective current is shared between them. If the blades are then arranged in a lead-lag arrangement, wherein one blade makes the contact before the others, then the deleterious effects associated with high current during contact closure are advantageously reduced or eliminated. Similarly, by laminating the movable arm with multiple electrically-conductive layers, the deleterious effects of tack-welding can be reduced.

There may advantageously be further provided a further first terminal, a further second terminal, a further movable arm, and a further actuation element, connected to the second end of the rocking armature for actuating the further movable arm, wherein latching the rocking armature to the first coil actuates the further movable arm in the first direction, and latching the rocking armature to the second coil actuates the further movable arm in the second direction.

Preferably, a contra-flowing current may pass through the movable arm and the further movable arm, creating a repulsive effect between the arms in the contacts-closed configuration.

As mentioned, the present contactor is capable of providing simultaneous actuation in two directions in a single latching motion, thereby allowing an opposingly cantilevered arrangement of movable arms within the contactor. Beneficially, this allows the current to contraflow between the arms. The associated magnetic fields generated in the arms will then be in opposition, such that the arms repel one another when in the contacts-closed configuration. Advantageously, this increases the contact pressure generated.

Preferably, the rocking armature includes two armlets positioned at an obtuse angle to one another.

Such a configuration of rocking armature ensures that a reasonable actuation occurs on latching, whilst also ensuring that the unlatched armlet of the armature remains within the generatable magnetic field of the opposing coil.

The electrical contactor may preferably further comprise a DC power supply for energizing the first and/or second coil, the DC power supply outputting drive pulses via a drive circuit.

Alternatively, the electrical contactor may further comprise an AC power supply for energizing the first and/or second coil, the AC power supply outputting drive pulses via a drive circuit.

Direct DC driven or AC driven contactors can be conceived, and a feedback stabilized actuator can be attuned to the zero-crossing of the associated load waveform to reduce the deleterious effects of contact erosion due to arcing.

The AC drive pulse may preferably have a half-cycle waveform profile, so as to reduce erosion energy between the contacts. Alternatively and most preferably, the AC drive pulse may have a quarter-cycle waveform profile, so as to prevent contact separation prior to peak load current.

Preferably, the driving of one of the coils may induce an electromagnetic field in the other coil, causing a mean tempering flux and damping effect to synchronize or substantially synchronize the opening and closing of the contacts with the AC waveform zero-crossing.

The truncation of the drive pulses to either half- or quarter-cycles helps to limit the damaging contact erosion energy available on contact closure. The quarter-cycle pulse is most advantageous, as the closing of the contacts cannot occur prior to the peak load current point. Closure before this point would ordinarily result in large and detrimental contact erosion energies.

A switch member includes a substantially flexible electrically-conductive movable arm, the movable arm being subdivided into a plurality of blades, of which, at least one blade is a lead blade, and at least one is a lag blade; and a plurality of movable contacts, each movable contact being associated with and located at a distal end of and on an upper face of a blade; wherein the or each lead blade is pre-formed and/or pre-loaded such that its associated movable contact is advanced of the or each movable contact associated with the or each lag blade, and during use, the or each movable contact associated with the or each lead blade enters a contacts-closed condition prior to the or each movable contact associated with the lag blade.

Preferably, the movable arm may be a tri-bladed movable arm, there being one lead blade and two lag blades. As previously discussed, the utilization of a lead-lag type movable arm can spread or split the effective current, which can in turn lead to a reduction in tack-welding of the contact on closure and/or reduced heat generation from the flowing current. The tri-blade configuration may utilize less contact material than an equivalent bi-blade configuration, and therefore a manufacturing cost-reduction is achievable, whilst still withstanding the ANSI short-circuit requirements at 5 K.Amp and 12 K.Amp levels.

According to a second aspect of the invention, there is provided a method of controlling electrical contact closing and opening delay of an electrical contactor, preferably in accordance with the first aspect of the invention, the method comprising the steps of driving a first coil of a magnetized dual-coil actuator to demagnetize the first coil, thereby increasing a net magnetic flux within a second coil, an armature latching to the second coil thereby causing an actuation to open or close electrical contacts.

Preferably, the first coil of the actuator may be energized with half-cycle waveform drive pulses to reduce or limit erosion energy between contacts. More preferably, the first coil of the actuator may be energized with quarter-cycle waveform drive pulses to prevent contact separation prior to peak load current.

Furthermore, the method may utilize an electrical contactor in accordance with the first aspect of the invention.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

FIGS. 7*a* to 7*e* show the actuator of FIG. 3 at various positions through its actuation cycle, inclusive of annotations to aid clarity;

DETAILED DESCRIPTION OF THE PREFERRED EMBODIMENTS

Figure 1:
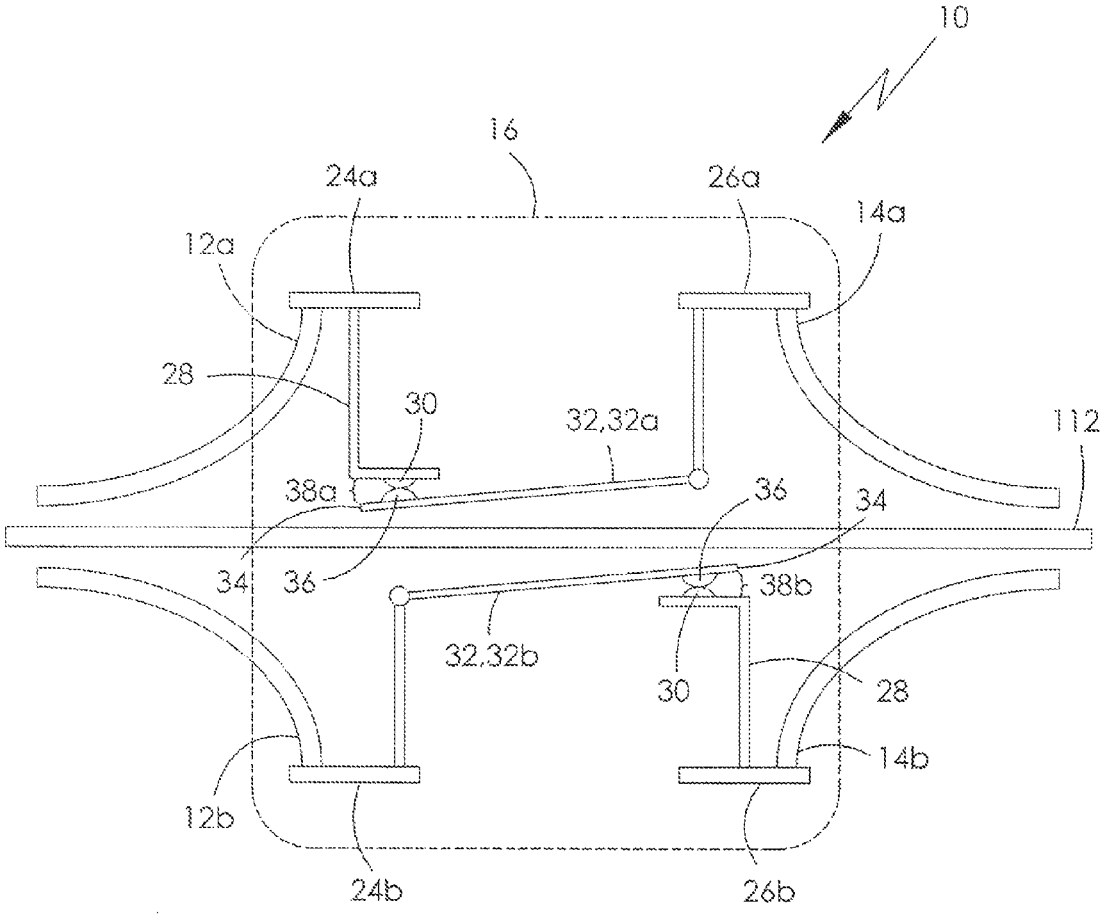
FIG. 1 is a diagrammatic representation of a first embodiment of an electrical contactor, in accordance with the first aspect of the invention.

Referring firstly to FIGS. 1 to 4 of the drawings, there is shown a first embodiment of an electrical contactor, specifically but not necessarily exclusively a repulsion contactor, globally shown at 10 and in this case being a two-pole device. Although a two-pole device is described, the suggested improvements may be applicable to a single pole device or a device having more than two poles.

The contactor 10 includes first and second outlet terminals 12*a*, 12*b* and first and second feed terminals 14*a*, 14*b*. Each terminal 12*a*, 12*b*, 14*a*, 14*b* extends from a contactor housing 16, each terminating with a terminal stab 18, and is mounted to a housing base 20 and/or an upstanding perimeter wall 22 of the contactor housing 16. The housing cover is not shown for clarity.

The first outlet terminal 12*a* and the second feed terminal 14*b* respectively include first outlet and second feed terminals pads 24*a*, 26*b*, and from each extends a fixed, preferably electrically-conductive, member 28 into the contactor housing 16. A fixed electrical contact 30 is mounted to each fixed member 28, facing towards the second outlet terminal 12*b* and first feed terminal 14*a* respectively.

The first feed terminal 14*a* and second outlet terminal 12*b* respectively include first feed and second outlet terminal pads 26*a*, 24*b*, and from each extends in opposingly cantilevered fashion an elongate movable arm 32, respectively, being first and second movable arms 32*a*, 32*b*. At or adjacent to a distal end 34 of each movable arm 32 is at least one movable electric contact 36.

The fixed electrical contact 30 and at least one movable contact 36 of the first outlet and first feed terminals 12*a*, 14*a*, and of the second outlet and second feed terminals 12*b*, 14*b* each form a contact set 38*a*, 38*b*.

It is important that the contacts used have adequate top-lay silver-alloy thickness in order to withstand the arduous switching and carrying duties involved, thus reducing contact wear. Prior art electrical contacts of an 8 mm diameter bi-metal have a silver-alloy top-lay thickness in a range 0.65 mm to 1.0 mm. This results in a considerable silver cost.

To address the issue of tack welding between contacts under high short-circuit loads, a particular compound top-lay can be utilized, in this case enriching the silver alloy matrix with a tungsten-oxide additive. Addition of the tungsten-oxide additive in the top-lay matrix has a number of important effects and advantages, amongst which are that it creates a more homogeneous top-lay structure, puddling the eroding surface more evenly, but not creating as many silver-rich areas, thus limiting or preventing tack-welding. The tungsten-oxide additive raises the general melt-pool temperature at the switching point, which again discourages tack-welding, and due to the tungsten-oxide additive being a reasonable proportion of the total top-lay mass, for a given thickness, its use provides a cost saving.

Figure 5:
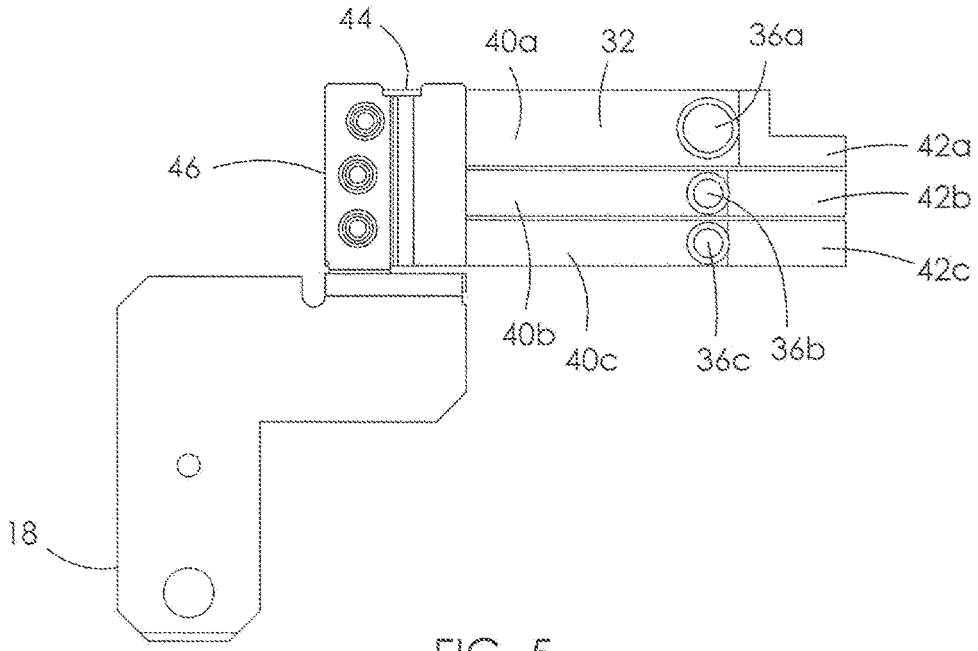
FIG. 5 shows a side view of a tri-bladed movable arm, in accordance with the second aspect of the invention and for use with the electrical contactor shown in FIG. 2.

In the present embodiment of the invention, each movable arm 32 is subdivided into three blades 40*a*, 40*b*, 40*c*, each blade 40*a*, 40*b*, 40*c* having an individual movable electrical contact 36*a*, 36*b*, 36*c*, this being shown in FIG. 5. Beyond each movable electrical contact 36*a*, 36*b*, 36*c* at the distal end 34 of each blade 40*a*, 40*b*, 40*c* extends a flexible tang 42*a*, 42*b*, 42*c*. The first or lead blade 40*a* is preferably wider than the second and third blades 40*b*, 40*c*. At a proximal end 44 of the movable arm 32 is at least one connective portion 46 for attaching the movable arm 32 to the relevant terminal pad 24*b*, 26*a*.

The American National Standards Institute (ANSI) requirements are particularly demanding for nominal currents up to 200 Amps. The short-circuit current is 12 K.Amp rms, but for a longer withstand duration of four full Load cycles, with 'safe' welding allowable. Furthermore, a "moderate" short-circuit current level of 5 K.Amps rms requirement may hold, wherein the contacts must not tack-weld over six full Load cycles.

Each movable arm 32 may therefore further include at least two electrically-conductive overlying layers, thereby effectively forming a laminated movable arm. Each layer is preferably thinner than single layer movable arms, and can therefore accommodate a greater heating effect. This will beneficially reduce the likelihood of tack-welding.

Extending diagonally between the second outlet terminal 12*b* and the first feed terminal 14*a* is a, preferably electrically-insulative, reinforcing element 48, the reinforcing element 48 not being in electrical communication with either terminal 12*b*, 14*a*. Each movable arm 32 is pre-loaded towards this reinforcing element 48, meaning that the default condition of the contactor in this particular arrangement is contacts-open.

Adjacent the second outlet and feed terminals 12*b*, 14*b* inside the contactor housing 16 is a dual-coil actuator 50.

Figure 2:
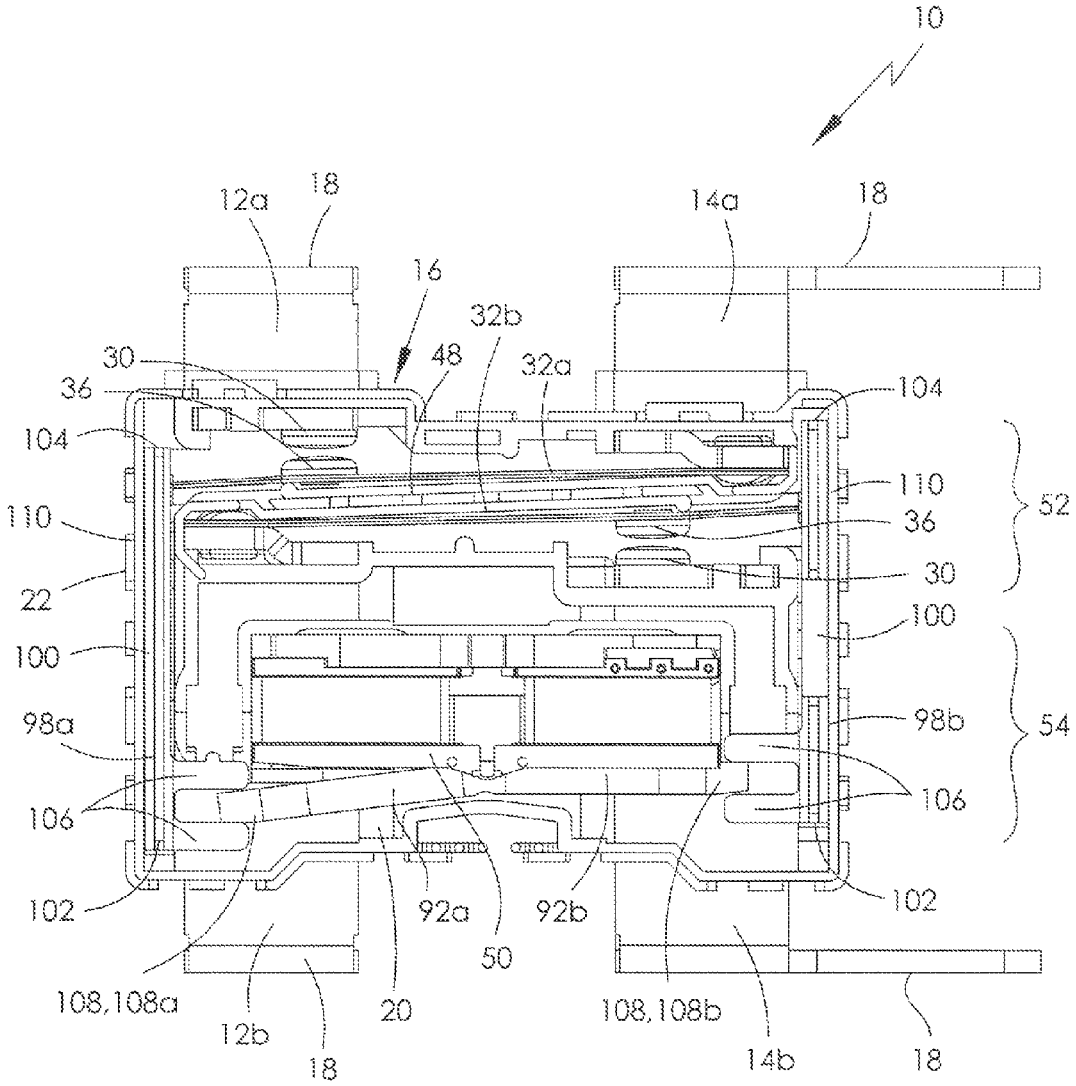
FIG. 2 shows a plan view of the electrical contactor of FIG. 1 with a cover removed, the contacts being in the contacts-open configuration.
Figure 3:
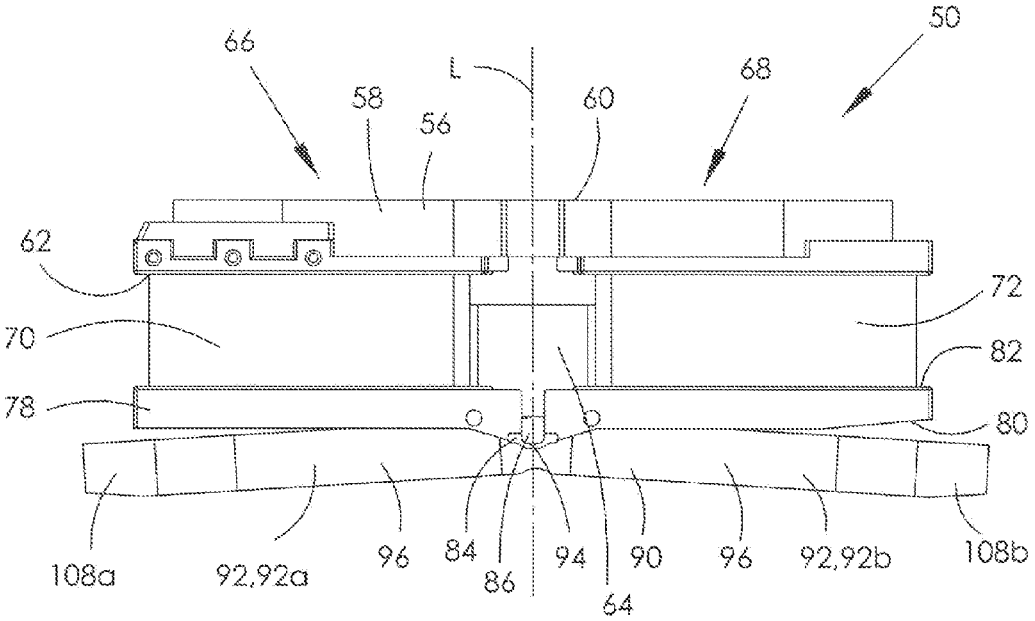
FIG. 3 shows an enlarged plan view of the actuator of the electrical contactor of FIG. 2.
Figure 4:
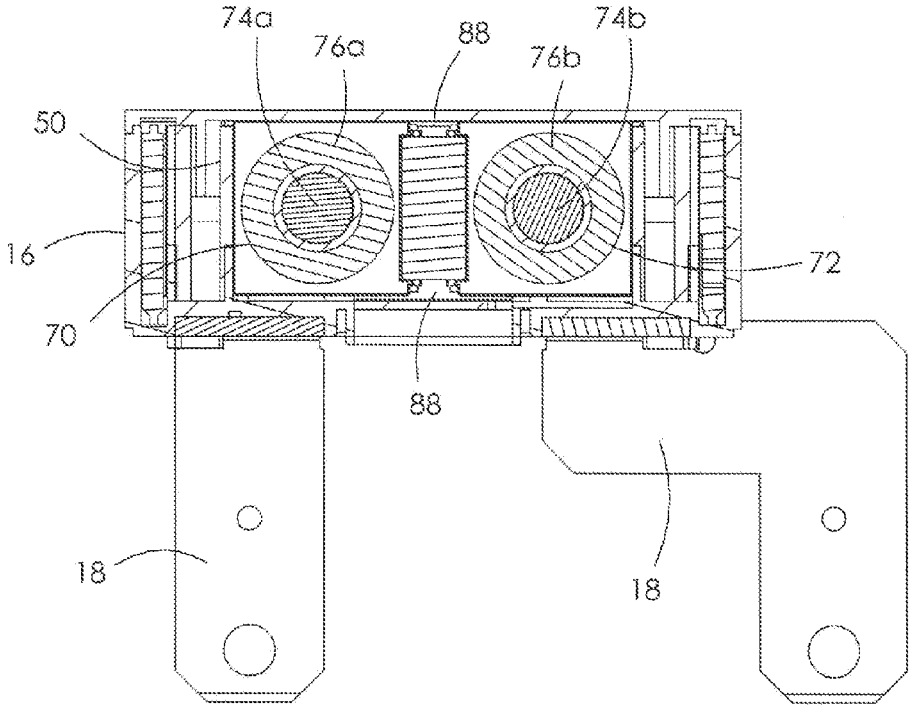
FIG. 4 is a side cross-sectional view of the electrical contactor of FIG. 2, the cross-section being taken through the actuator as shown in FIG. 3.

The contactor housing 16 can therefore be considered to have two sides; a contact side 52 in which resides the movable arms 32, and an actuator side 54 in which is located the actuator 50, as shown in FIG. 2.

The actuator preferably comprises a ferrous yoke 56 including a thin, substantially rectangular base plate 58 having upper and lower rectangular faces 60, 62. Extending from the upper rectangular face 60 along a lateral centerline L of the actuator 50 is a permanent magnet stack 64, thereby defining a left-hand side 66 and a right-hand side 68 of the actuator 50. The magnet stack 64 preferably comprises at least one rare-earth magnet. However, rather than a stack, a single unitary, preferably permanent, magnetic element may be utilized.

Extending from the left-hand side 66 of the upper rectangular face 60 of the base plate 58 is a first drivable coil 70, and extending from the right-hand side 68 of the upper rectangular face 60 is a second drivable coil 72. Each coil 70, 72 comprises a central, cylindrical ferrous core 74*a*, 74*b* around which is wrapped electrically-conductive wire windings 76*a*, 76*b* in a tight helix.

The yoke 56 further comprises a cap plate 78 having a substantially similar shape to the base plate 58, the cap plate 78 including upper and lower rectangular faces 80, 82. The lower rectangular face 82 abuts the upper edges of the permanent magnet stack 64 and the coils 70, 72.

On the upper face 80 of the cap plate 78 is a fulcrum 84 aligned along the lateral centerline L of the actuator 50. The fulcrum 84 comprises a freely rotating pivot pin 86 affixed to the cap plate 78 by two end caps 88.

There is further provided a rocking armature 90 integrally formed as two elongate opposing armlets 92, each connected at a central point 94 such that the body 96 of each armlet 92 is positioned at an obtuse angle to the other. The rocking armature 90 is connected to the freely rotating pivot pin 86, thereby allowing the rocking armature 90 to pivot about the fulcrum 84. Each armlet 92 is therefore associated with either the left-hand side 66 or the right-hand side 68 of the actuator 50, thereby defining a left-hand side armlet 92*a* and a right-hand side armlet 92*b*.

There are further provided left-hand side and right-hand side sliding actuation elements 98*a*, 98*b* which interconnect the actuator 50 and the movable arms 32. Each actuation element 98*a*, 98*b* comprises an elongate body 100 having first and second ends 102, 104, having in this case two projections 106 located at the first end 102 for engagement with a free end 108 of an armlet 92 of the rocking armature 90, and a slotted lifter 110 at the second end 104 for engaging with the tangs 42*a*, 42*b*, 42*c* of an associated movable arm 32.

The first tang 42*a* is engaged with the slotted lifter 110 slightly closer to the second end 104 of each actuation element 98*a*, 98*b*, thereby ensuring that the first movable contact 36*a* contacts with the fixed contact 30 before the second and third movable contacts 36*b*, 36*c*.

The left-hand side actuation element 98*a* engages with a free end 108*a* of the left-hand side armlet 92*a*, and with a distal end 34 of the first movable arm 32*a*, extending from the first feed terminal 14*a*. The right-hand side actuation element 98*b* engages with a free end 108*b* of the right-hand side armlet 92*b*, and with a distal end 34 of the second movable arm 32*b*, extending from the second outlet 12*b* terminal.

The first and second coils 70, 72 are individually drivable, and therefore can be driven sequentially to effect actuation of the rocking armature 90. Without driving the coils 70, 72, there is a magnetic flux present generated by the permanent magnet stack 68, which is spread across the left-hand side 66 and right-hand side 68 of the actuator 50. Under these circumstances, the rocking armature 90 will not experience any strong latching force to either side 66, 68.

Figure 6:
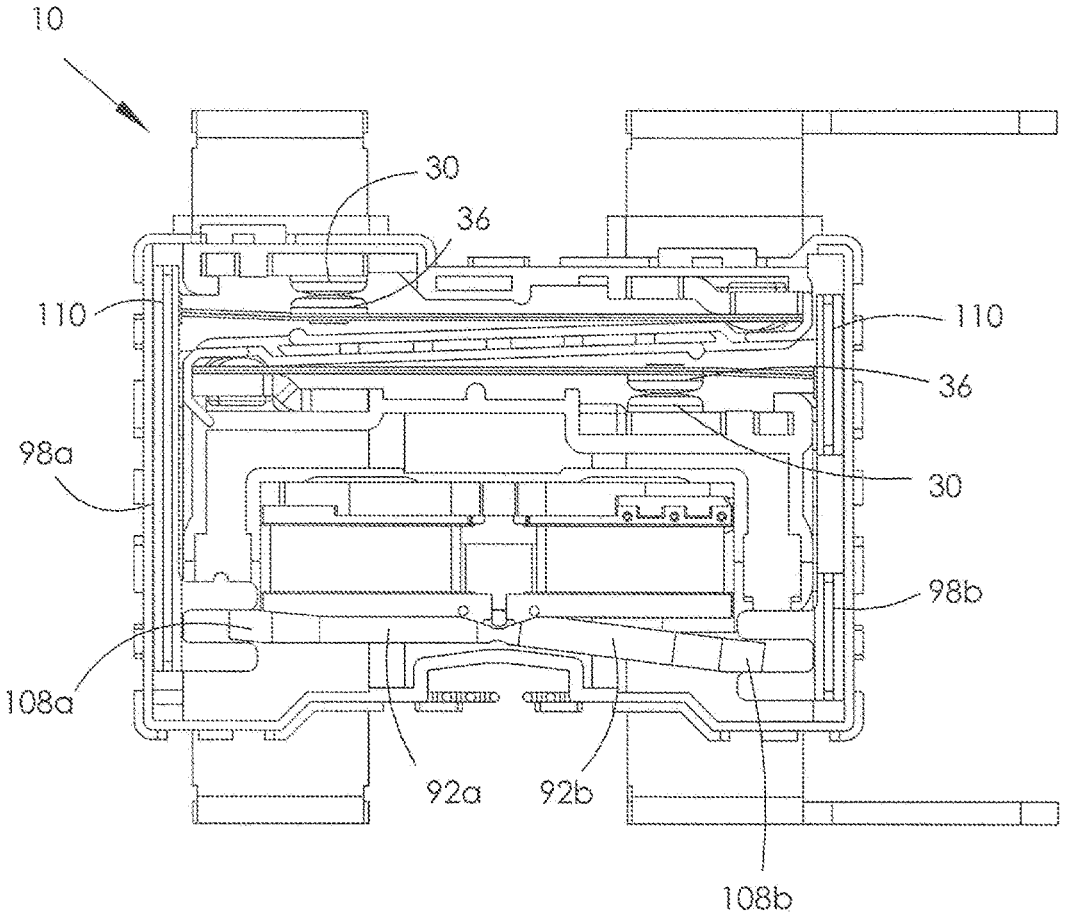
FIG. 6 is similar to FIG. 2, but showing the electrical contactor with the contacts in the contacts-closed configuration.

The contacts-open and contacts-closed conditions of the contactor 10 are illustrated in FIGS. 2 and 6 respectively, wherein the motion of the left- and right-hand side actuation elements 98*a*, 98*b* is shown, moving the tangs 42*a*, 42*b*, 42*c* of the movable arms 32*a*, 32*b*.

Driving of a coil 70, 72 causes a demagnetization affect in the associated coil 70, 72, and through the ferrous yoke 56 of the side 66, 68 of the actuator 50 in which the coil 70, 72 is located. This will cause a corresponding rise in the magnetic flux present in the opposing side 68, 66. The increased magnetic flux will therefore attract the rocking armature 90 to the opposing coil 72, 70. As such, an actuation sequence can be generated, as illustrated in FIGS. 7*a* to 7*e*.

In use and with reference to FIGS. 7*a* to 7*e*, the second coil 72 will be driven, demagnetizing or reducing the magnetic flux in the right-hand side 68, causing a corresponding increase in the magnetic flux in the left-hand side 66. The left-hand side armlet 92*a* will therefore be attracted towards the first coil 70 and will latch at the left-hand side 66. The left-hand side actuation element 98*a* will therefore slide upwards towards the contact side 52 of the contactor housing 16, simultaneously pushing the first movable arm 32*a*.

As the rocking armature 90 pivots about the fulcrum 62, the right-hand side armlet 92*b* will be actuated away from the second coil 72, sliding the right-hand side actuation element 98*b* towards the actuator side 54, thereby pulling the second movable arm 32*b*. The left-hand side 66 latched configuration is shown in FIG. 7*a*.

The simultaneous pushing of the first movable arm 32*a* and the pulling of the second movable arm 32*b* closes both of the contact sets 38 as the movable contacts 36*a*, 36*b*, 36*c* are brought into contact with the or respective fixed contacts 30. When making contact, the first movable contacts 36*a* contact with the respective fixed contacts 30 a fraction earlier than the second and third contacts 36*b*, 36*c*. Since the current load is spread between the blades 40*a*, 40*b*, 40*c* in this embodiment, this delay reduces the likelihood of tack-welding.

When the first coil 70 is driven, the left-hand side 66 is demagnetized or has imparted a reduced magnetic flux, and the left-hand side armlet 92*a* of the rocking armature 90 delatches from the first coil 70. The delatched state of the actuator 50 is shown in FIG. 7*b*.

The driving of the first coil 70 causes an increase in the magnetic flux in the right-hand side 68. The right-hand side armlet 92*b* will be attracted towards the second coil 72 and will latch at the right-hand side 68. The right-hand side actuation element 98*b* will therefore slide towards the contact side 52, pushing the second movable arm 32*b*. This position is shown in FIG. 7*c*.

Similarly the left-hand side armlet 92*a* will be actuated away from the first coil 70, sliding the left-hand side actuation element 98*a* towards the actuator side 54, thereby pulling the first movable arm 32*a*. This particular actuation then causes the breaking of the contact sets 38 as the movable contacts 36*a*, 36*b*, 36*c* are brought out of contact with the fixed contact 30.

The second coil 72 may then be driven again, thereby causing a demagnetization in the right-hand side 68, the right-hand side armlet 92*b* of the rocking armature 90 delatching from the second coil 72. This delatched state of the actuator 50 is shown in FIG. 7*d*. The subsequent increase in magnetic flux in the first coil 70 will then attract the left-hand side armlet 92*a*, causing it to latch to the first coil 70, completing the actuation cycle as shown in FIG. 7*e*.

The driving of the coils 70, 72 of the actuator 50 can be achieved in a variety of ways.

Firstly, the finish of the coil winding 76*a* of the first coil 70 may be connected to the start of the coil winding 76*b* of the second coil 72 via a Common connection 112. The two windings 76*a*, 76*b* are wound around their respective cores 74*a*, 74*b* in the same direction, face-to-face, in series. Each coil 70, 72 may then be DC pulse-driven, by a DC power supply through an appropriate drive circuit, separately to achieve the rocking actuation as previously described.

Alternatively, since the actuator 50 is fast acting when driven strongly, the DC pulse may be replaced with an AC driving pulse. Since the windings 76*a*, 76*b* are connected in series, the coils 70, 72 may be driven by a single AC pulse from an AC power supply through an appropriate drive circuit, the positive cycle of the pulse energizing and demagnetizing the second coil 72 and closing the contacts, and the negative cycle of the pulse energizing and demagnetizing the first coil 70 and opening the contacts.

Although the coils are preferably connected in series, if may be feasible to connect the coils in other configurations to achieve the same or similar end result.

The advantage of an AC driving pulse is that when the driven coil 70, 72 is energized and therefore demagnetized or having a reduced magnetic flux, the other coil 72, 70 experiences an induced electromagnetic field, causing a mean tempering flux and damping effect during the pivoting of the rocking armature 90. This damping effect delays and stabilizes the contact closing time, more or less proportionally to the supply voltage amplitude.

Additionally, by providing a driving pulse having a truncated waveform profile, such as a half-cycle drive pulse, a quarter cycle drive pulse, and/or possible further truncation variants, the possible contact erosion energy available to be discharged on contact closure can be significantly reduced.

Figure 8:
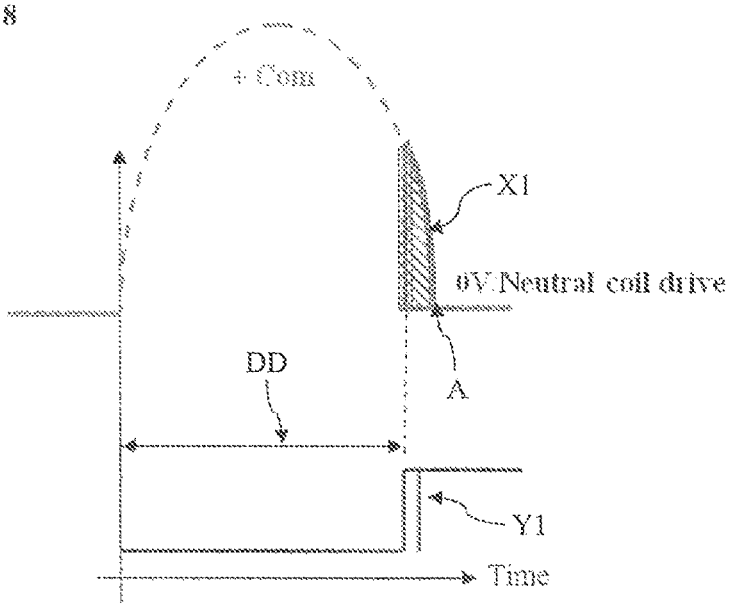
FIG. 8 graphically represents the additional control over the closing of the contacts provided by the electrical contactor when driven by a positive half-cycle drive pulse.
Figure 9:
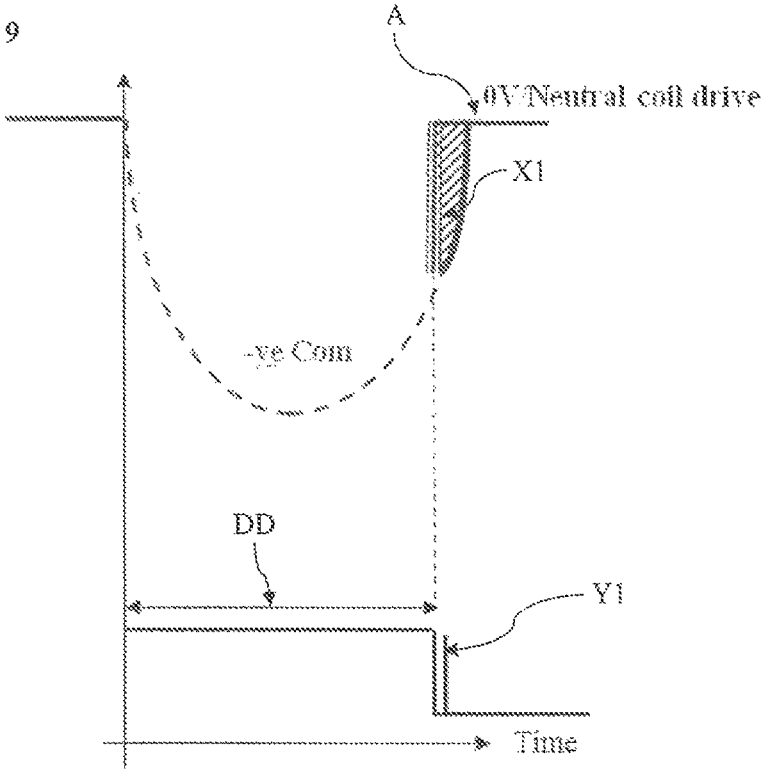
FIG. 9, similarly to FIG. 8, graphically represents the additional control over the opening of the contacts provided by the electrical contactor when driven by a negative half-cycle drive pulse.
Figure 10:
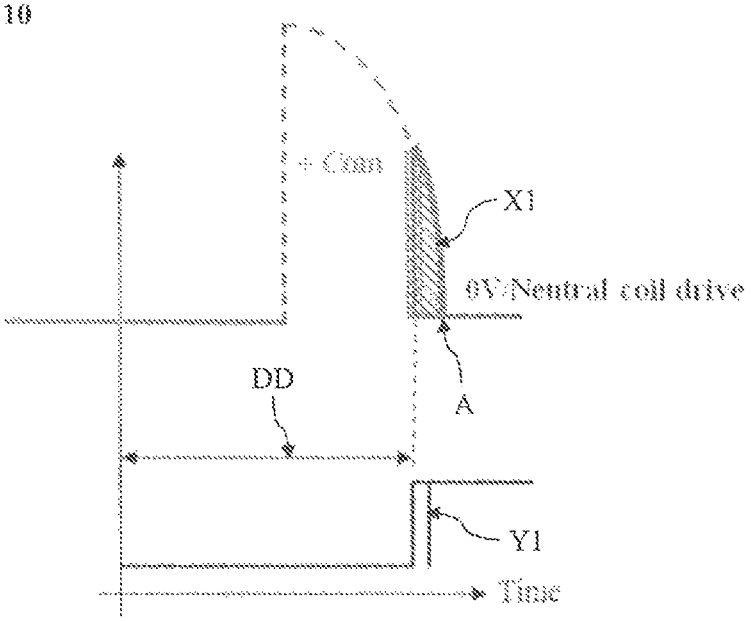
FIG. 10 graphically represents the additional control over the closing of the contacts provided by the electrical contactor when driven by a positive quarter-cycle drive pulse.
Figure 11:
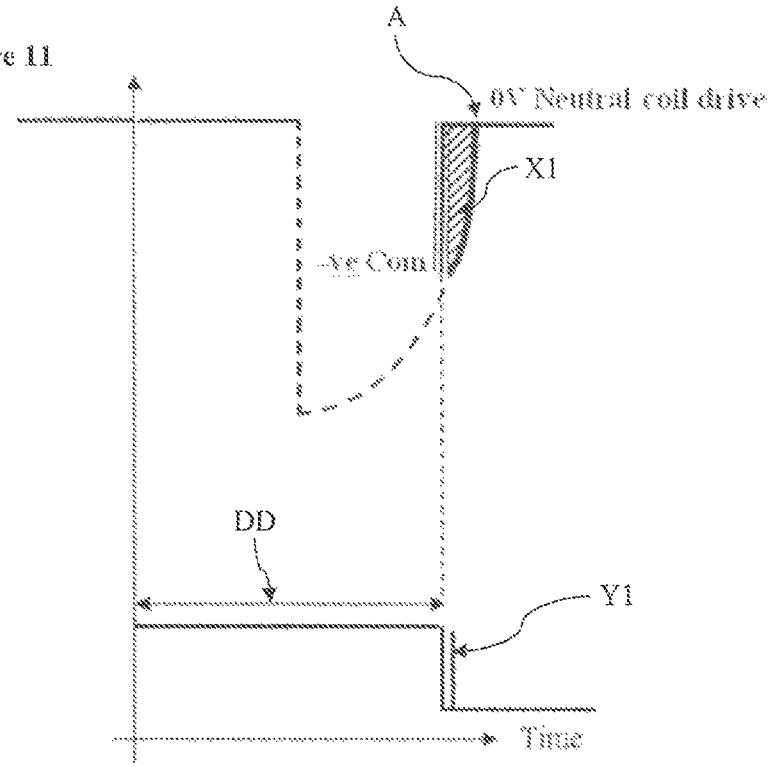
FIG. 11, similarly to FIG. 10, graphically represents the additional control over the opening of the contacts provided by the electrical contactor when driven by a negative quarter-cycle drive pulse.

As shown in FIGS. 8 and 9 for the case of a half-cycle drive pulse, or FIGS. 10 and 11 for a quarter-cycle drive pulse, the contact opening time can be controlled and therefore shifted to or adjacent to the AC load waveform zero-crossing point A, by carefully matching the coils, the strength of the feedback connection, and therefore the controlled delay of the opening of the contacts. As such arcing and thus contact erosion energy X1 is reduced or eliminated, prolonging contact life or improving endurance life. Possible contact bounce Y1, is also shifted to or much closer to the zero-crossing point A, again improving contact longevity and robustness during opening.

By way of example, a standard or traditional contact opening and closing time may include a dynamic delay DD of 5 to 6 milliseconds, primarily due to the time taken to delatch the rocking armature 90. By using the control of the present invention, this dynamic delay is fractionally extended to 7 to 8 milliseconds to coincide more closely or synchronize with the next or subsequent zero-crossing point of the AC load waveform. Synchronization or substantial synchronization of the dynamic delay DD with the zero-crossing point A will reduce arcing and contact erosion energy. The AC drive pulse may preferably be shaped so as to have a half-cycle pulse profile to achieve this delay.

If the contactor 10 is used over a wide range of supply voltages, the dynamic delay DD can vary greatly between the different voltages. The higher the supply voltage, the more rapid the actuation of the rocking armature. As a result, with a half-cycle drive pulse, there is a possibility of a very short dynamic delay DD, which may lead to contact closure occurring at or before the peak load current.

If the dynamic delay DD is short due to a high or higher AC supply voltage. The subsequent contact erosion energy X1 may be very large. This large contact erosion energy X1 may damage the contacts, lessening their lifespans.

The contact erosion energy X1 can be further reduced by using an AC supply which energizes the coils 70, 72 with a truncated drive pulse, in this case preferably being a quarter-cycle drive pulse, in place of the half-cycle drive pulse. In this arrangement, the quarter-cycle drive pulse will not trigger and thus drive the first or second drive coil 70, 72 until the peak load current is reached. As such, this can be considered a 'delayed' driving approach.

By triggering the truncated-cycle, being in this case a quarter-cycle, drive pulse on the peak load current, the closing of the contacts can never occur prior to the peak load current. However, by utilizing a control circuit as part of the power supply outputting to the electrical actuator, a degree of truncation of the current waveform on the time axis can be carefully selected and optimized based on the peak load current, the required contact opening and closing force and delay, and the arc and/or erosion energy imparted to the contacts during the contact opening and closing procedures. As such, although a quarter-cycle drive pulse is preferred, since this coincides with the peak load current, it may be beneficial for a controller outputting an energisation current to the actuator to be set to truncate the waveform of the drive pulse to be prior or subsequent to the peak load current.

The dynamic delay DD is still preferably configured to synchronize or substantially synchronize with the zero-crossing point A, thereby minimizing the contact erosion energy X1 even further. However, when utilized together with the controlled truncated waveform of the drive pulse, this is achieved in a more controlled manner than with the half-cycle drive pulse.

Although the AC drive pulse may be truncated, it may be feasible to also truncate the DC drive pulse, which in some situations may be beneficial in terms of reducing arcing and/or contact erosion.

It will be appreciated that the present invention as described above is merely a single embodiment, and other means of achieving the same result can be conceived. For instance, the fulcrum of the rocking armature is described as being a pivot pin attached to the cap plate of the yoke of the actuator. However, any suitable pivoting means could be utilized as part of the contactor, provided that the resultant actuation were the same.

Whilst the fixed contacts in the contactor are described as being a single monolithic contact which may contact with multiple movable contacts, it may be preferable to provide a corresponding plurality of fixed contacts thereby reducing the amount of material used to create the fixed contacts.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of example only, and various other modifications will be apparent to persons skilled in the field without departing from the scope of the invention as defined by the appended claims.

The invention claimed is:

1. An electrical contactor comprising:

a first terminal having a fixed member with at least one fixed electrical contact;

a second terminal;

an electrically-conductive movable arm in electrical communication with the second terminal and having a movable electrical contact thereon; and actuator including a centrally mounted magnet, first and second drivable coils located either side of the magnet, a magnetically-attractable rocking armature pivotable at a point between the first and second coils, and an actuation element connected to an end of the rocking armature for actuating the movable arm;

a further first terminal, a further second terminal, a further movable arm, and a further actuation element, connected to a second end of the rocking armature for actuating the further movable arm, wherein driving the first coil causes a decrease of magnetic flux in the first coil, causing a corresponding increase in magnetic flux in the second coil, the rocking armature thus latching to the second coil, thereby actuating the movable arm in a first direction, and driving the second coil causes a decrease of magnetic flux in the second coil, causing a corresponding increase in magnetic flux in the first coil, the rocking armature thus latching to the first coil, thereby actuating the movable arm in a second direction, and wherein latching the rocking armature to the first coil actuates the further movable arm in the first direction, and latching the rocking armature to the second coil actuates the further movable arm in the second direction.

2. The electrical contactor of claim 1, wherein the first and second coils are interconnected to a common center connection.

3. The electrical contactor of claim 1, wherein the movable arm is a bladed switch.

4. The electrical contactor of claim 1, wherein the movable arm is split into a blade set having a plurality of movable contacts.

5. The electrical contactor of claim 4, wherein the movable arm is tri-bladed switch.

6. The electrical contactor of claim 1, wherein the movable arm includes at least two electrically-conductive overlying layers, thereby reducing a flexure force.

7. The electrical contactor of claim 1, wherein a contraflowing current passes through the movable arm and the further movable arm, imparting a repulsive force supplementarily urging the movable arms apart in the contacts-closed configuration.

8. The electrical contactor of claim 1, wherein the rocking armature includes two armlets positioned at an obtuse angle to one another.

9. The electrical contactor of claim 1, further comprising a DC power supply for energizing the first and/or second coils, the DC power supply outputting drive pulses via a drive circuit.

10. The electrical contactor of claim 1, further comprising an AC power supply for energizing the first and/or second coil, the AC power supply outputting drive pulses via a drive circuit.

11. The electrical contactor of claim 10, wherein the drive pulse has a truncated waveform profile, so as to reduce erosion energy between the contacts.

12. The electrical contactor of claim 11, wherein the drive pulse has a half-cycle waveform profile, so as to reduce erosion energy between the contacts.

13. The electrical contactor of claim 11, wherein the drive pulse has a quarter-cycle waveform profile, so as to prevent contact separation prior to peak load current.

14. The electrical contactor of claim 10, wherein the driving of one of the coils induces an electromagnetic field in the other coil, causing a mean tempering flux and damping effect to synchronize or substantially synchronize the opening and closing of the contacts with the AC waveform zero-crossing.

15. The electrical contactor of claim 14, wherein the said driving of one of the coils induces an electromagnetic field in the other coil, when the first and second coils are connected in series.

16. A method of controlling electrical contact closing and opening delay of the electrical contactor of claim 1, the method comprising the steps of driving a first coil of a magnetized dual-coil actuator to reduce a magnetic flux in the first coil, thereby increasing a net magnetic flux within a second coil, an armature latching to the second coil thereby causing an actuation to open or close electrical contacts.

17. The method of claim 16, wherein magnetic flux is increased in the second coil when connected in series to the first coil.

18. The method of claim 16, wherein the first coil of the actuator is energized with a truncated waveform drive pulse to reduce or limit erosion energy between contacts.

19. The method of claim 18, wherein the truncated waveform drive pulse is a half-cycle waveform drive pulse to reduce or limit erosion energy between contacts.

20. The method of claim 19, wherein the truncated waveform drive pulse is a quarter-cycle waveform drive pulse to prevent or limit contact separation and/or closure prior to peak load current.

* * * * *